United States Patent [19]

Parker

[11] 4,200,115

[45] Apr. 29, 1980

[54] AWNING

[76] Inventor: George Parker, 3105 Brawner Pkwy., Corpus Christi, Tex. 78415

[21] Appl. No.: 931,289

[22] Filed: Aug. 4, 1978

[51] Int. Cl.[2] ..... A45F 1/14

[52] U.S. Cl. ..... 135/5 A; 135/1 A; 135/7.1 A

[58] Field of Search ..... 135/7.1 R, 7.1 A, 5 R, 135/5 A, 1 A; 248/38

[56] References Cited

U.S. PATENT DOCUMENTS

| | | | |
|---|---|---|---|
| 2,166,625 | 7/1939 | Deak | 135/5 R |
| 2,508,757 | 5/1950 | Gray | 135/5 A |
| 3,195,898 | 7/1965 | Respini | 135/5 R |
| 3,404,696 | 10/1968 | DeSouza | 135/5 R |
| 3,940,099 | 2/1976 | McClesky | 135/3 A |

FOREIGN PATENT DOCUMENTS

| | | | |
|---|---|---|---|
| 1380412 | 1/1975 | United Kingdom | 135/5 A |

*Primary Examiner*—Reinaldo P. Machado

[57] ABSTRACT

There is disclosed an awning which is adapted to be supported by a pair of spaced members on which two wheels of a motor vehicle are driven. Support projections incline upwardly from the member and removeably receive a plurality of elongate supports. The elongate supports comprise a pair of spaced upstanding tubular members on which a fabric canopy is supported. The awning can be quickly erected and dismantled and makes no contact with the motor vehicle except on the underside of the wheels thereof.

16 Claims, 4 Drawing Figures

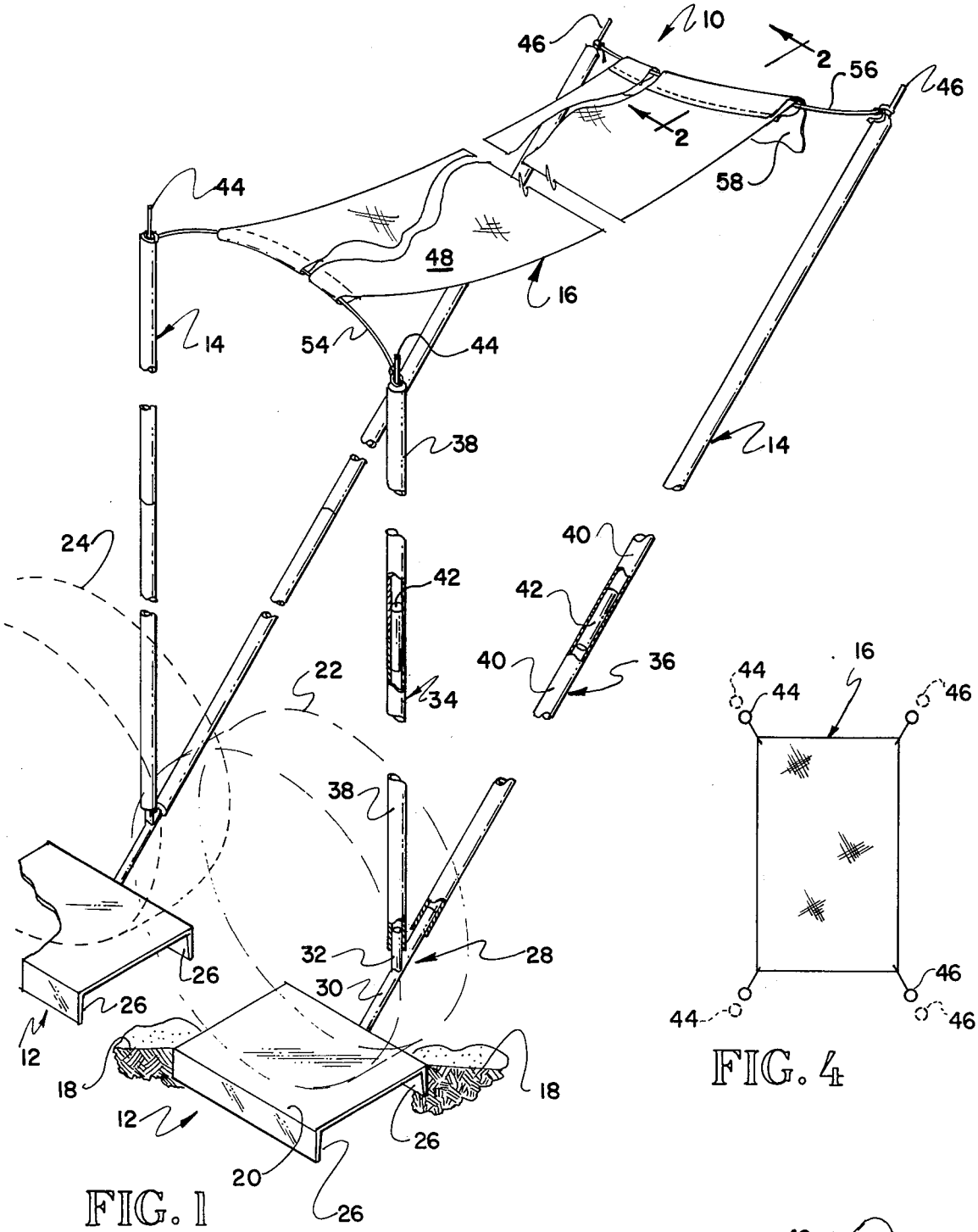
FIG. 1
FIG. 4
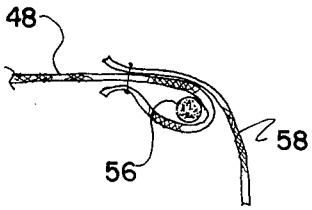
FIG. 2
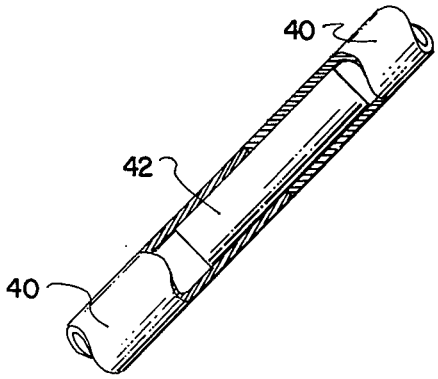
FIG. 3

AWNING

This invention relates to an awning which is adapted to be anchored to a motor vehicle and particularly such an awning which can be quickly erected and dismantled.

There are presently commercially available a wide variety of awnings which can be erected adjacent a motor vehicle and which use the motor vehicle as a support or anchor for the awning. Although these devices are more-or-less satisfactory, they leave something to be desired in a number of respects. First, all of the presently commercially available types generally require stakes to be driven into the ground and ropes connecting the stakes with vertical supports to guy the supports. Because of the requirement of guyed supports, the presently commercially available awnings require two people for erection. Second, the present commercially available awnings require a multiplicity of components which necessarily increases the cost of such a device.

In summary, the awning of this invention comprises a pair of separate support plates having a generally flat section onto which a front and rear wheel of a motor vehicle is driven. A support protuberance inclines upwardly from the support member and terminates in a diverging fork. The two legs of each diverging fork are designed to receive an elongate support comparable to a tent pole. The supports upwardly diverge and, in the assembled condition, form a pair of spaced generally vertical supports for a fabric material constituting a canopy. The canopy is connected to the upstanding supports merely by tying a rope to the upper end of each support.

It is an object of this invention to provide an improved awning construction of the type using an adjacent motor vehicle as a support or anchor and particularly to an inexpensive awning of this type which can be quickly assembled and dissembled.

Other objects and advantages of this invention will become more fully apparent hereinafter as the description proceeds, reference being had to the accompanying claims and drawing.

IN THE DRAWING:

FIG. 1 is an isometric view of an assembled awning of this invention;

FIG. 2 is an enlarged cross-sectional view of the device of FIG. 1 taken substantially along line 2—2 thereof as viewed in the direction indicated by the arrows;

FIG. 3 is a broken view illustrating the connection between the elongate support members of FIG. 1; and FIG. 4 is a top view of the device illustrating another feature of the invention.

Referring to FIG. 1, the awning 10 of this invention comprises a pair of spaced support members or plates 12, a pair of spaced generally vertically extending supports 14 and a canopy 16 connected adjacent the top of the supports 14.

The support members 12 comprise the sole connection between the remainder of the awning 10 and a ground surface 18. The support members 12 each comprise a generally planar support surface 20 which is positioned under a wheel 22, 24 of a motor vehicle which is basically used as a weight rendering the support members 12 immobile. The support members 12 conveniently comprise a channel shaped structure having a pair of flanges 26 extending downwardly from the support plate 20. Welded to one of the flanges 26 is an inclined support protuberance 28 including a generally linear rod 30 having an upstanding rod-like ear 32 secured thereto in any suitable fashion, as by welding or the like. It will be apparent that the rod 30 and ear 32 reside in a common vertical plane and that the rod 30 and ear 32 provide an upwardly diverging fork for reasons more fully pointed out hereinafter.

The supports 14 may be of any suitable type commensurate with the function of connecting the support members 12 to the canopy 16. Desirably, the supports 14 are readily and expeditiously connected to the support members 12, can be disassembled into elements of handy length, and are sufficiently strong to withstand normal loads imposed on the awning 10.

To these ends, the support 14 each comprise a pair of elongate support members 34, 36 which can be quickly assembled and disassembled from the support members 12. Desirably, the elongate support members 34, 36 comprise a plurality of tubular sections 38, 40 interconnected by a rod 42 closely received in the internal passage of adjacent tubular sections as shown best in FIG. 3.

The upper end of the uppermost tubular sections 38, 40 is provided with a tie-down 44, 46 for conveniently securing the canopy 16 to the support 14.

The canopy 16 comprises a section of flexible sheet material 48 of any convenient type. The sheet material is desirably of rectangular configuration in which the long edges are reverted and stitched to form a pair of loops 50, 52 to receive a rope 54, 56 or other suitable elongate tensile element. A decorative fringe 58 may be sewn to the sheet 48 as desired.

In a shipped condition, the components of the awning 10 are disassembled and housed in a suitable carton or case. When arriving at the location where the awning 10 is to be set up, the motor vehicle is stopped and the support members 12, 14 placed either immediately in front or immediately in back of the wheels 22, 24 on one side of the motor vehicle with the support protuberances 28 extending laterally of the vehicle. The vehicle is then either moved forwardly a short distance or moved rearwardly a short distance so that the wheels 22, 24 are positioned on top of the support surfaces 20. The user then erects the supports 14 by connecting the tubular sections 38, 40 and placing the elongate supports members 34, 36 on the ear 32 and rod 30 respectively. The canopy 16 is installed merely by tying the ropes 54, 56 to the tie-downs 44, 46 on one side of the awning 10, pulling the ropes 54, 56 tight and tying them off on the tie-down 44, 46 on the opposite side of the awning 10. Erection of the awning 10 is then complete. It will be evident that the supports 14 are not guyed and consequently that the sole support for the awning 10 are the support members 12. It will likewise be noted that the elongate support members 34 are spaced laterally of the motor vehicle and make no connection therewith except under the wheels 22, 24. In this regard, it is desirable that the elongate support members 34 be at least 2 inches and preferably on the order of at least about 4 inches from the flange 26 to avoid scratching or marring of the surface finish of the motor vehicle.

It will be noted that the canopy 16 is not directly tied to the tie-downs 44, 46 but is instead supported by the ropes 54, 56 which are connected to the tie-downs 44, 46. It will be evident that the distance between the opposite ends of the canopy 16 and the supports 14 will vary depending on the length of the wheelbase of the vehicle employed as the anchor for the awning 10. This is of considerable advantage because a single sized awning may be used with vehicles of widely varying wheelbase. In vehicles with short wheelbases, the gap between the ends of the canopy 16 and the supports 14 is rather short.

The awning 10 is remarkably easy and quick to erect. It is, of course, erectable by one individual. The elapsed time between the start of erection, with all of the components unassembled and lying on the ground, and the completion of erection is on the order of about three minutes with a single individual doing the erecting. Disassembly time is even shorter and is on the order of about one minute.

Referring to FIG. 4, another feature of the invention is illustrated. FIG. 4, which is a top view of the awning 10, illustrates the location of the tie-downs 44, 46 in dotted lines with the supports 14 in a relaxed condition. When the canopy 16 is snugly tied off to the tie-downs 44, 46, as by the provision of the ropes 54, 56, the support members 34, 36 are inwardly flexed to position the tie-downs 44, 46 in the solid line positions which are disposed inwardly of the rectangle defined by the dotted line positions thereof. This flexing of the support members 34, 36 adds considerable structural integrity to the awning 10 and improves its ability to withstand external loads which may, for example, be imposed by wind.

The awning 10 is surprisingly sturdy. Although it has not been tested in wind tunnels or the like, a prototype has been erected in an area that was experiencing 30 mph winds. Under these conditions, the awning 10 was surprisingly stable.

Although the invention has been described in its preferred form with a certain degree of particularity, it is understood that the disclosure of the preferred embodiment has been made only by way of example and that numerous changes in the details of construction and combination and arrangement of parts may be resorted to without departing from the spirit and scope of the invention as hereinafter claimed. It is intended that the patent shall cover, by suitable expression in the appended claims, whatever features of patentable novelty exists in the invention disclosed.

I claim:

1. A readily erectable and disassemblable awning of the type using a motor vehicle as an anchor, comprising a pair of spaced support members adapted to be placed on an underlying ground surface for receiving a wheel of the motor vehicle thereby anchoring the support members, each support member including first support means comprising support protuberances having an upwardly diverging fork providing first and second connectors;

a pair of spaced generally vertically extending supports each comprising first and second elongate members having a first end providing second support means removably connectable with the first and second connectors and a second end; and a canopy and means for connecting the canopy to the support adjacent the second ends thereof.

2. The awning of claim 1 wherein the elongate members each comprise a plurality of sections and means for connecting the sections together.

3. The awning of claim 2 wherein the sections each comprise a tubular end and the means connecting the sections together comprises a rod sized to closely receive the tubular section ends.

4. The awning of claim 3 wherein the sections each comprise a second tubular end, and the first and second connectors each comprise a rod sized to closely receive the second tubular ends.

5. The awning of claim 1 wherein the support protuberances are rigidly connected to the support plates.

6. The awning of claim 1 wherein the canopy comprises a section of flexible sheet material and the means for connecting the canopy to the supports comprises a section of elongate tensile element extending from opposite sides of the canopy to the support, the distance from the sides of the canopy to the supports being variable depending on the spacing between the support members.

7. The awning of claim 6 wherein the sheet material provides a loop on opposite sides of the material and the elongate tensile element extends through each of the loops.

8. The awning of claim 1 wherein the support members constitute the sole connection between the awning and the underlying ground surface.

9. The awning of claim 8 wherein the support members comprise a generally planar wheel support surface and a flange extending generally perpendicular thereto, and the first support means comprises a support protuberance rigid with the flange.

10. The awning of claim 9 wherein the support protuberances each comprise an elongate rod inclined relative to the support plate and an ear extending upwardly from the rod generally perpendicular to the support surface.

11. In combination, a motor vehicle having at least a pair of spaced wheels and an awning of the type using the motor vehicle as an anchor, comprising a pair of spaced support members placed on an underlying ground surface, each support member having one of the vehicle wheels positioned thereon and including first support means;

a pair of spaced generally vertically extending supports each comprising a pair of upwardly diverging support members each having a first end providing second support means removably connected to the first support means in load bearing relation therewith and a tie-down adjacent a second end thereof, the tie-downs being spaced apart a predetermined distance when the diverging support members are in an unstressed condition; and a rectilinear canopy and elongate tensile element sections extending from the corners of the canopy to the tie-downs, the tensile element sections being sufficiently stressed to flex the diverging support members to locations spaced closer than the predetermined distances.

12. The combination of claim 11 wherein the support members constitute the sole connection between the awning and the vehicle.

13. A readily erectable and disassembleable awning of the type using a motor vehicle as a support thereof, comprising a pair of spaced support members adapted to be placed on an underlying ground surface for receiving a wheel of the motor vehicle thereby anchoring the support members, each support member including first and second support connectors;

a pair of supports each comprising first and second elongate members having a first end removably connectable with the first and second connectors and a second end; and a canopy and means for connecting the canopy to the supports adjacent the second ends thereof.

14. The awning of claim 13 wherein the first and second connectors define an axis of connecting movement, the axes being non-parallel.

15. The awning of claim 14 wherein the axes are upwardly divergent.

16. The awning of claim 13 wherein the support members comprise the sole connection between the awning and the vehicle.

* * * * *